US012070056B2

(12) United States Patent
Jung et al.

(10) Patent No.: US 12,070,056 B2
(45) Date of Patent: Aug. 27, 2024

(54) AEROSOL-GENERATING ARTICLE HAVING FLAVOR OPTIMIZATION FUNCTION AND AEROSOL GENERATION SYSTEM INCLUDING THE SAME

(71) Applicant: KT&G CORPORATION, Daejeon (KR)

(72) Inventors: Yong Mi Jung, Daejeon (KR); Sung Hoon Ha, Daejeon (KR); Eun Mi Jeoung, Daejeon (KR); Jun Won Shin, Daejeon (KR); John Tae Lee, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 605 days.

(21) Appl. No.: 17/297,248

(22) PCT Filed: Dec. 21, 2020

(86) PCT No.: PCT/KR2020/018747
§ 371 (c)(1),
(2) Date: May 26, 2021

(87) PCT Pub. No.: WO2021/172724
PCT Pub. Date: Sep. 2, 2021

(65) Prior Publication Data

US 2022/0264935 A1 Aug. 25, 2022

(30) Foreign Application Priority Data

Feb. 25, 2020 (KR) ..... 10-2020-0022751

(51) Int. Cl.
*A24F 47/00* (2020.01)
*A24D 1/02* (2006.01)
(Continued)

(52) U.S. Cl.
CPC ..... *A24D 1/02* (2013.01); *A24D 1/20* (2020.01); *A24D 3/17* (2020.01); *A24F 40/20* (2020.01)

(58) Field of Classification Search
CPC ... A24D 1/02; A24D 1/20; A24D 3/17; A24D 3/048; A24D 3/067; A24F 40/20; A24F 40/46; A24F 40/40; A24F 40/57
See application file for complete search history.

(56) References Cited

U.S. PATENT DOCUMENTS 8,839,799 B2 9/2014 Conner et al.
2007/0215168 A1* 9/2007 Banerjee ..... A24D 1/22 131/335
(Continued)

FOREIGN PATENT DOCUMENTS

CN 110101124 A 8/2019
KR 10-2016-0096590 A 8/2016
(Continued)

OTHER PUBLICATIONS

Japanese Office Action issued Jun. 27, 2023 in Application No. 2021-516428.
(Continued)

*Primary Examiner* — Abdullah A Riyami
*Assistant Examiner* — Nelson R. Burgos-Guntin
(74) *Attorney, Agent, or Firm* — Sughrue Mion, PLLC

(57) ABSTRACT

Provided herein are an aerosol-generating article having a flavor optimization function and an aerosol generation system including the same. The aerosol-generating article according to some embodiments of the present disclosure includes a filter portion, a medium portion which includes an aerosol-generating substrate and has a downstream end portion connected to an upstream end portion of the filter portion, and a wrapping structure which wraps around at
(Continued)

least a portion of the filter portion or the medium portion. Here, the wrapping structure may include a heat conduction member or a heat conduction limiting member to appropriately control thermal energy delivered to the aerosol-generating substrate. Accordingly, the flavor and taste of tobacco smoke of the aerosol-generating article may be improved.

11 Claims, 10 Drawing Sheets

(51) Int. Cl.

| | |
|---|---|
| ***A24D 1/20*** | (2020.01) |
| ***A24D 3/17*** | (2020.01) |
| ***A24F 40/20*** | (2020.01) |

(56) References Cited

U.S. PATENT DOCUMENTS

| | | | | |
|---|---|---|---|---|
| 2008/0092912 | A1* | 4/2008 | Robinson | A24B 3/14 131/200 |
| 2015/0216237 | A1* | 8/2015 | Wensley | A24F 40/48 131/273 |
| 2016/0270445 | A1* | 9/2016 | Liu | H01M 50/213 |
| 2017/0055576 | A1* | 3/2017 | Beeson | A24D 1/02 |
| 2019/0098927 | A1* | 4/2019 | Mironov | A24F 40/50 |
| 2019/0183177 | A1* | 6/2019 | Hubbard | A24F 40/485 |
| 2019/0261685 | A1 | 8/2019 | Sebastian et al. | |

FOREIGN PATENT DOCUMENTS

| | | | |
|---|---|---|---|
| KR | 10-2019-0005853 | A | 1/2019 |
| KR | 10-2019-0120413 | A | 10/2019 |
| WO | 2020/002910 | A1 | 1/2020 |
| WO | 2020/009454 | A1 | 1/2020 |
| WO | 2020/032715 | A1 | 2/2020 |
| WO | 2020/115150 | A1 | 6/2020 |
| WO | 2021/034004 | A1 | 2/2021 |

OTHER PUBLICATIONS

Extended European Search Report dated Feb. 16, 2022, issued in European Application No. 20888739.8.

International Search Report for PCT/KR2020/018747 dated, Apr. 8, 2021 (PCT/ISA/210).

Office Action dated Mar. 31, 2023 from the Chinese Patent Office in Application No. 202080006048.7.

* cited by examiner

[FIG. 1]
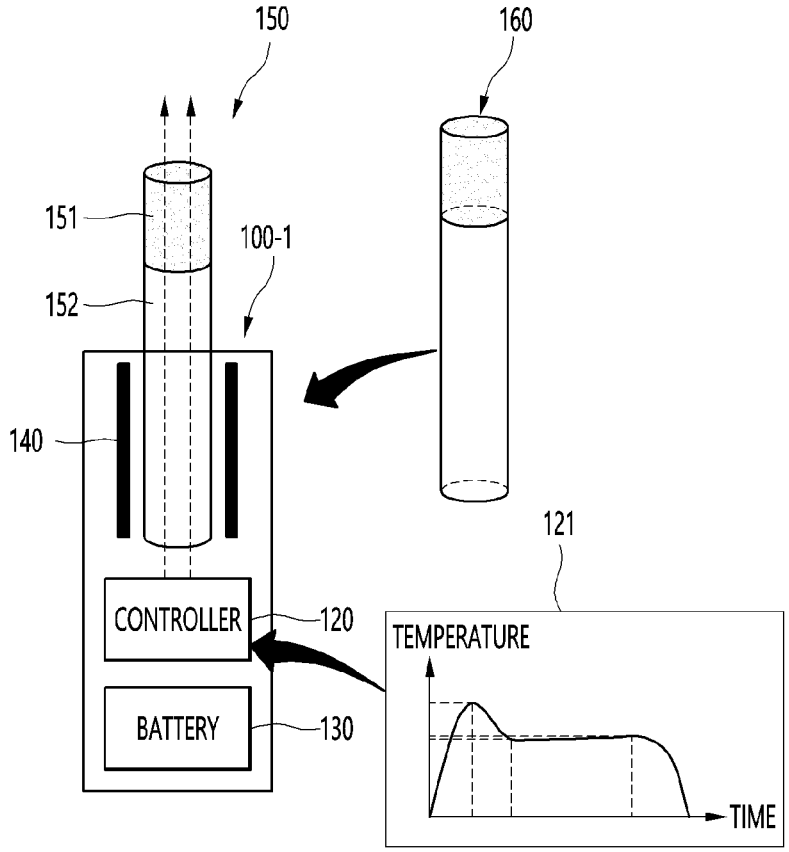

[FIG. 2]
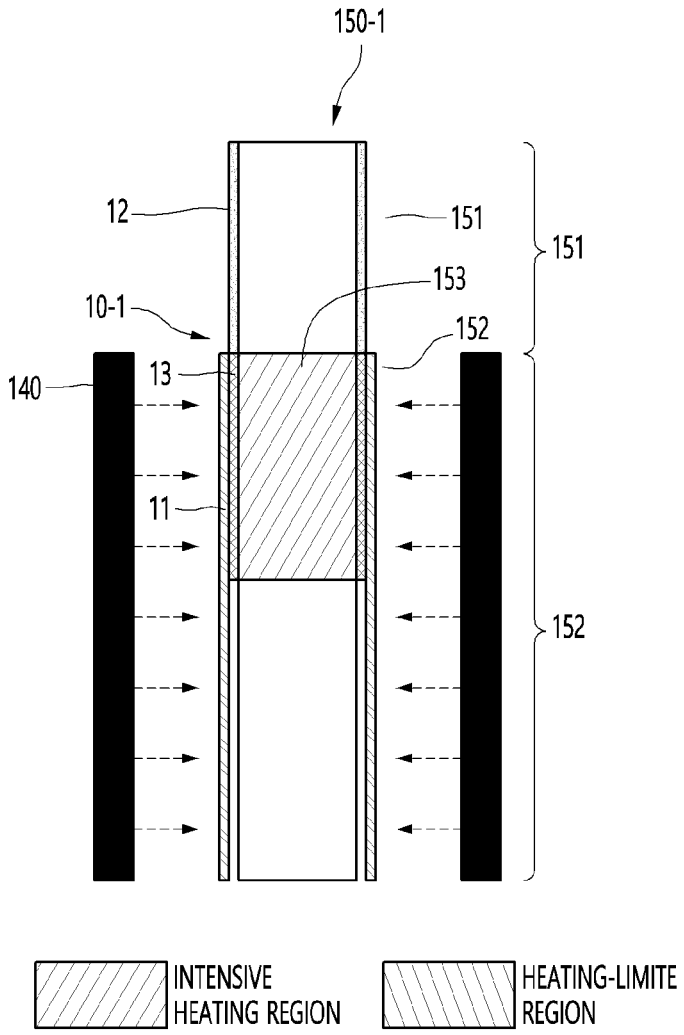

[FIG. 3]
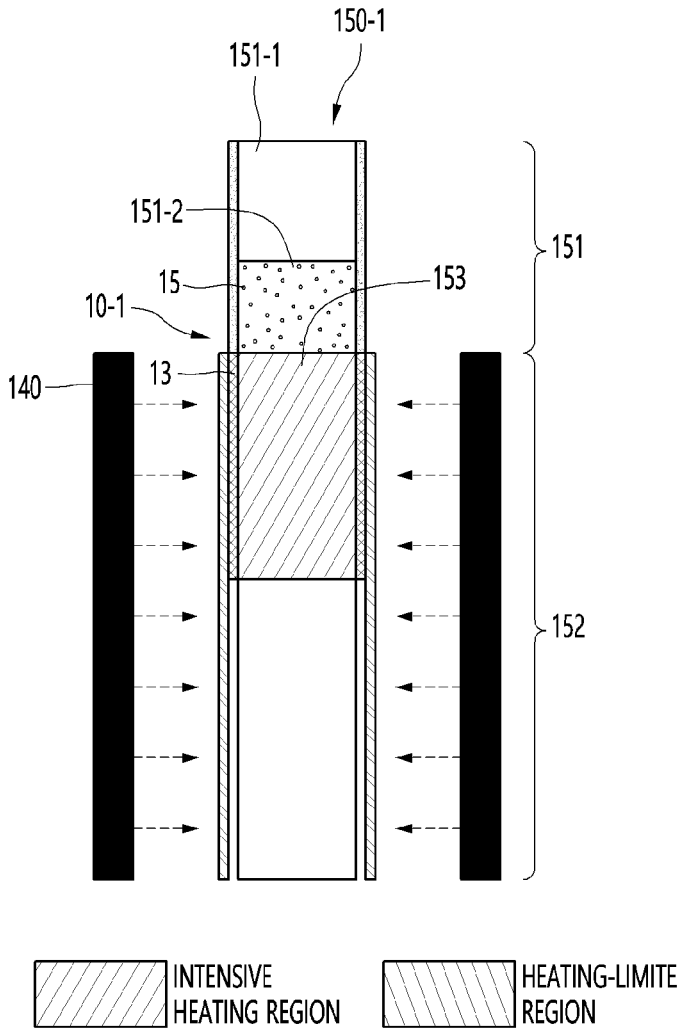

[FIG. 4]
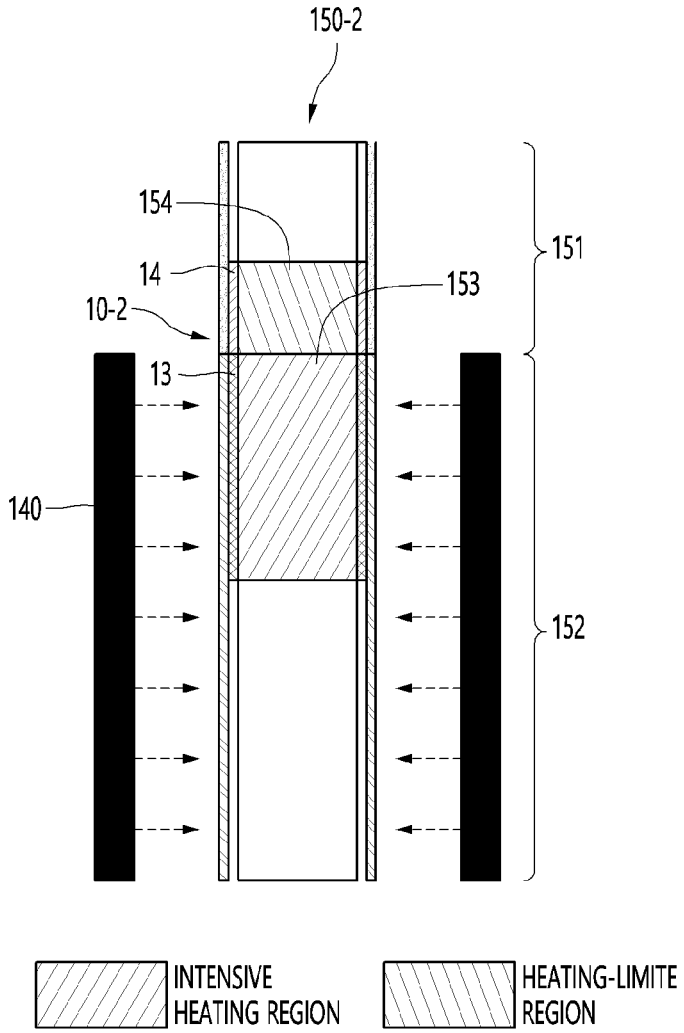

[FIG. 5]
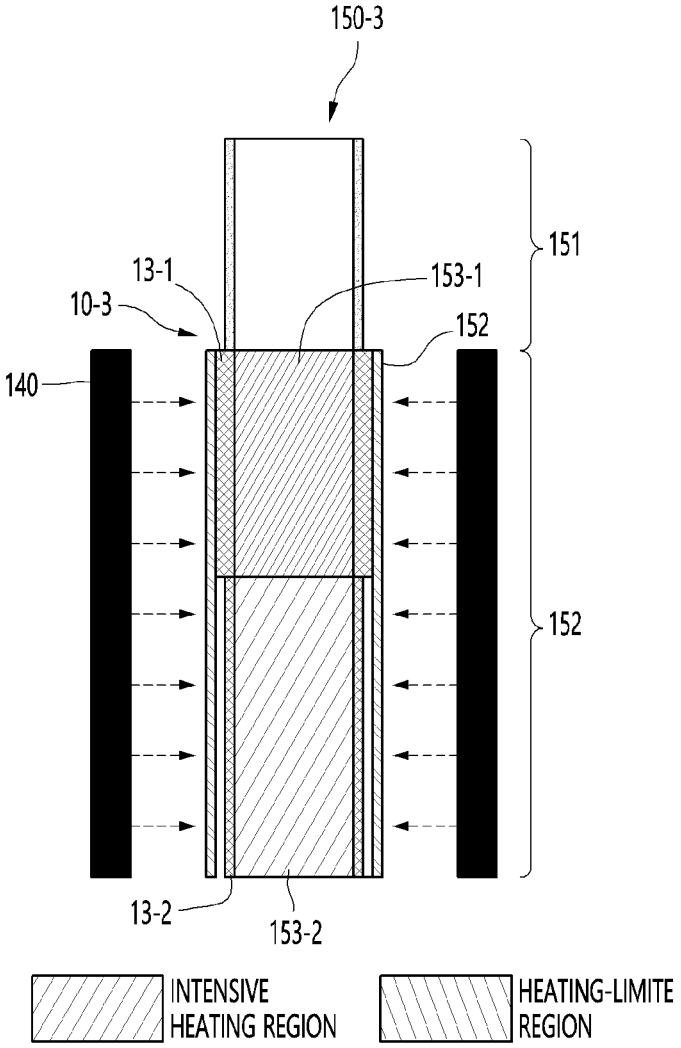

[FIG. 6]
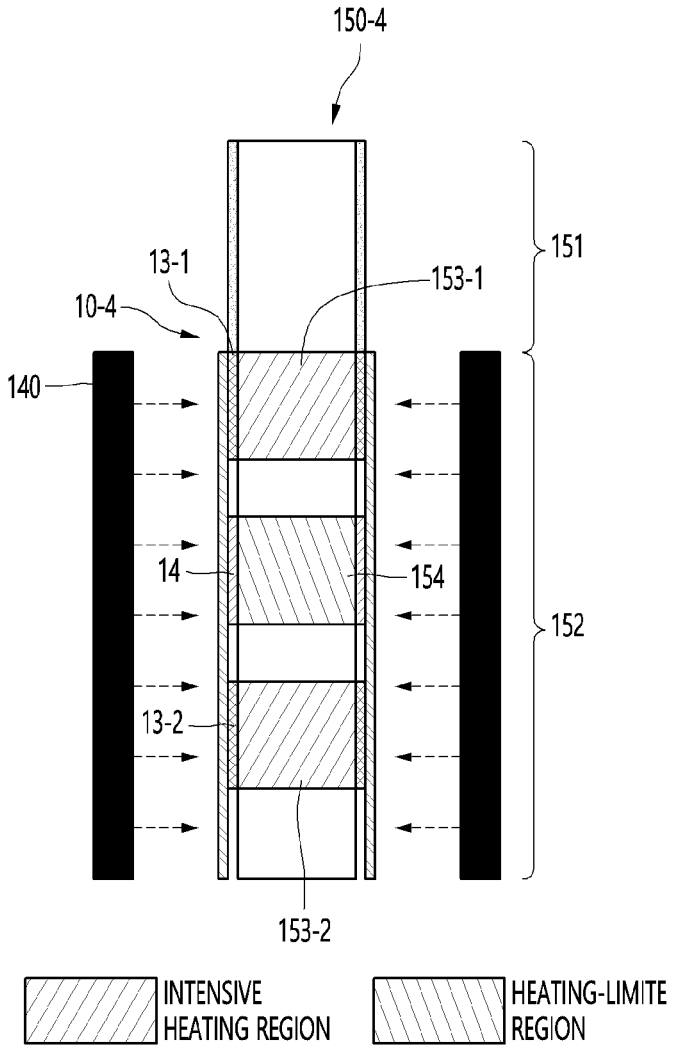

[FIG. 7]
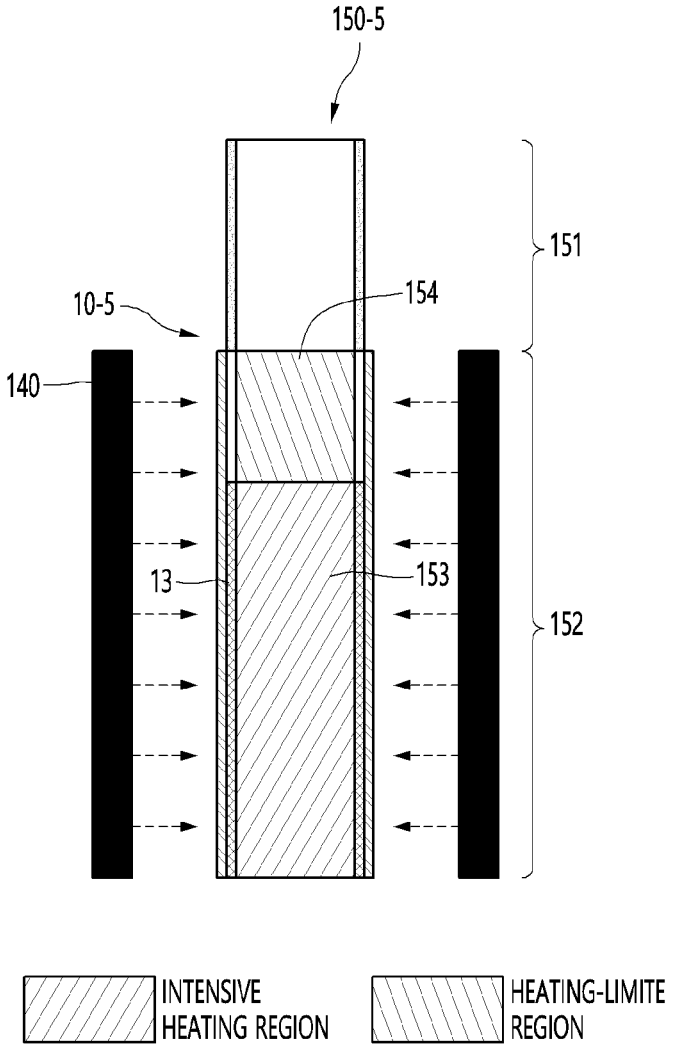

[FIG. 8]
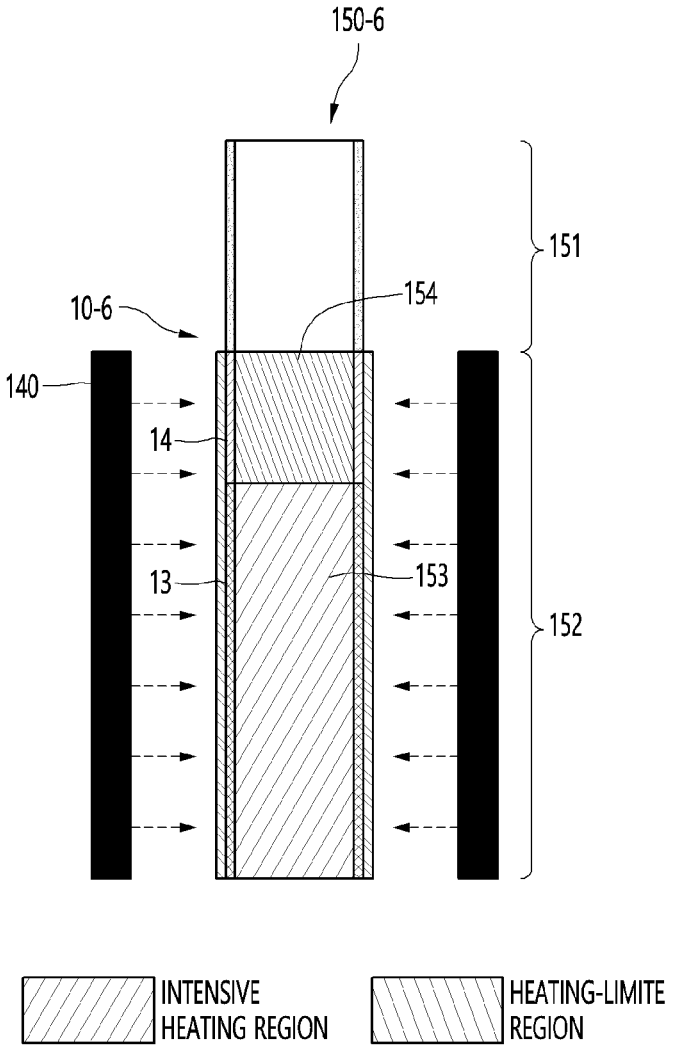

[FIG. 9]
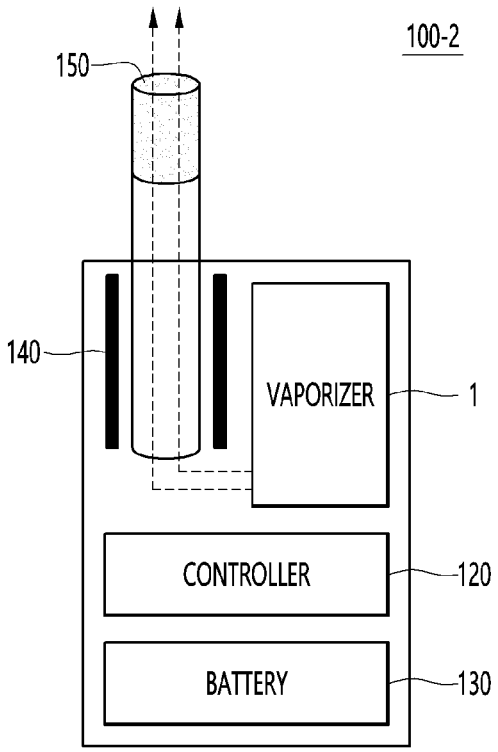

[FIG. 10]
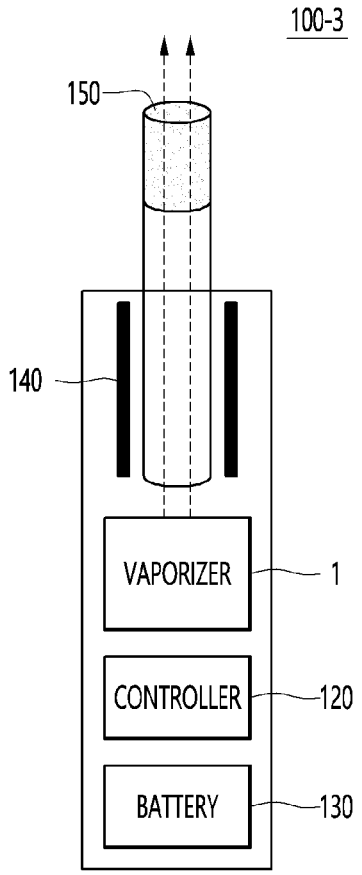

AEROSOL-GENERATING ARTICLE HAVING FLAVOR OPTIMIZATION FUNCTION AND AEROSOL GENERATION SYSTEM INCLUDING THE SAME

TECHNICAL FIELD

The present disclosure relates to an aerosol-generating article having a flavor optimization function and an aerosol generation system including the same, and more particularly, to an aerosol-generating article capable of, by controlling thermal energy reaching an aerosol-generating substrate, providing an optimized flavor during smoking and an aerosol generation system including the same.

BACKGROUND ART

In recent years, demand for alternative smoking articles that overcome disadvantages of traditional cigarettes has increased. For example, demand for aerosol generation devices (e.g., cigarette-type electronic cigarettes) that electrically heat cigarettes to generate an aerosol has increased, and accordingly, active research has been carried out on electric heating-type aerosol generation devices.

Generally, a single temperature profile is installed in an electric heating-type aerosol generation device. The installed temperature profile is designed in advance for a target aerosol-generating article to have a maximum flavor. Therefore, when a different aerosol-generating article is applied, the original taste and flavor of the article may not be delivered to a user due to a difference in the temperature profile.

DISCLOSURE

Technical Problem

Some embodiments of the present disclosure are directed to providing an aerosol-generating article having a flavor optimization function and an aerosol generation system including the same.

Some embodiments of the present disclosure are also directed to providing an aerosol-generating article, which is capable of providing an optimized flavor without changing a temperature profile pre-installed in an aerosol generation device, and an aerosol generation system including the same.

Some embodiments of the present disclosure are also directed to providing an aerosol-generating article in which an initial taste of tobacco smoke is improved and an aerosol generation system including the same.

Some embodiments of the present disclosure are also directed to providing an aerosol-generating article in which a filtering effect for an aerosol is improved and an aerosol generation system including the same.

Objectives of the present disclosure are not limited to the above-mentioned objectives, and other unmentioned objectives should be clearly understood by those of ordinary skill in the art to which the present disclosure pertains from the description below.

Technical Solution

An aerosol-generating article according to some embodiments of the present disclosure includes a filter portion, a medium portion which includes an aerosol-generating substrate and has a downstream end portion connected to an upstream end portion of the filter portion, and a wrapping structure which wraps around at least a portion of the filter portion or the medium portion. Here, the wrapping structure may include a heat conduction member disposed in the vicinity of the downstream end portion of the medium portion.

In some embodiments, the heat conduction member may include a metal foil or a paper-laminated metal foil.

In some embodiments, the wrapping structure may further include a heat conduction limiting member disposed in a downstream direction of the heat conduction member.

In some embodiments, the heat conduction member may be a first heat conduction member, the wrapping structure may further include a second heat conduction member disposed at a different position from the first heat conduction member, and the first heat conduction member may be thicker than the second heat conduction member.

In some embodiments, the heat conduction member may be a first heat conduction member, the wrapping structure may further include a second heat conduction member disposed at a different position from the first heat conduction member, and the first heat conduction member may include a material having a higher thermal conductivity than the second heat conduction member.

In some embodiments, the heat conduction member may be a first heat conduction member, and the wrapping structure may further include a second heat conduction member disposed around a first region of the medium portion and a heat conduction limiting member disposed around a second region of the medium portion.

An aerosol-generating article according to some other embodiments of the present disclosure includes a filter portion, a medium portion which includes an aerosol-generating substrate and has a downstream end portion connected to an upstream end portion of the filter portion, and a wrapping structure which wraps around at least a portion of the filter portion or the medium portion. Here, the wrapping structure may include a heat conduction member disposed at a position excluding the vicinity of the downstream end portion of the medium portion.

In some embodiments, the wrapping structure may further include a heat conduction limiting member disposed in the vicinity of the downstream end portion of the medium portion.

An aerosol generation system according to some embodiments of the present disclosure includes a first aerosol-generating article, a second aerosol-generating article having a wrapping structure that is at least partially different from a wrapping structure of the first aerosol-generating article, and an aerosol generation device which includes an accommodation space for accommodating the first aerosol-generating article or the second aerosol-generating article, and configured to heat the second aerosol-generating article accommodated in the accommodation space according to a temperature profile of the first aerosol-generating article to generate an aerosol.

Advantageous Effects

According to various embodiments of the present disclosure, by customizing a wrapping structure of an aerosol-generating article, a flavor of the aerosol-generating article can be optimized. In particular, without a need to change a temperature profile installed in an aerosol generation device or to add a new temperature profile thereto, the flavor of the aerosol-generating article can be optimized even under the pre-installed temperature profile. This makes it possible for an article manufacturer to develop aerosol-generating articles for competitors' devices in which a temperature profile cannot be installed, and thus its market competitiveness can be improved.

Also, various aerosol-generating articles having different flavors can be manufactured without changing an aerosol-generating substrate. Accordingly, product diversification can be easily achieved, and since this stimulates a consumer's desire to purchase, the market competitiveness of the article manufacturer can be further improved.

Also, since an intensive heating region is formed in the vicinity of a downstream end of a medium portion due to a heat conduction member of a wrapping structure, an aerosol can be generated smoothly upon a first puff. This can lead to improvement in an initial smoking taste of an aerosol-generating article and the overall flavor of the aerosol-generating article.

In addition, since a heating-limited region is formed in the vicinity of the downstream end of the medium portion due to a heat conduction limiting member of the wrapping structure, a filtering effect for the aerosol can be improved.

The advantageous effects according to the technical idea of the present disclosure are not limited to the above-mentioned advantageous effects, and other unmentioned advantageous effects should be clearly understood by those of ordinary skill in the art from the description below.

DESCRIPTION OF DRAWINGS

FIG. 1 is an exemplary configuration diagram illustrating an aerosol generation system according to some embodiments of the present disclosure.

FIGS. 2 and 3 schematically illustrate a wrapping structure and an aerosol-generating article including the same according to a first embodiment of the present disclosure.

FIG. 4 schematically illustrates a wrapping structure and an aerosol-generating article including the same according to a second embodiment of the present disclosure.

FIG. 5 schematically illustrates a wrapping structure and an aerosol-generating article including the same according to a third embodiment of the present disclosure.

FIG. 6 schematically illustrates a wrapping structure and an aerosol-generating article including the same according to a fourth embodiment of the present disclosure.

FIG. 7 schematically illustrates a wrapping structure and an aerosol-generating article including the same according to a fifth embodiment of the present disclosure.

FIG. 8 schematically illustrates a wrapping structure and an aerosol-generating article including the same according to a sixth embodiment of the present disclosure.

FIGS. 9 and 10 are exemplary block diagrams illustrating various types of aerosol generation devices to which the aerosol-generating article according to some embodiments of the present disclosure is applicable.

MODES OF THE INVENTION

Hereinafter, exemplary embodiments of the present disclosure will be described in detail with reference to the accompanying drawings. Advantages and features of the present disclosure and a method of achieving the same should become clear with embodiments described in detail below with reference to the accompanying drawings. However, the technical idea of the present disclosure is not limited to the following embodiments and may be implemented in various other forms. The embodiments make the technical idea of the present disclosure complete and are provided to completely inform those of ordinary skill in the art to which the present disclosure pertains of the scope of the present disclosure. The technical idea of the present disclosure is defined only by the scope of the claims.

In assigning reference numerals to components of each drawing, it should be noted that the same reference numerals are assigned to the same components as much as possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein. Terms used herein are for describing the embodiments and are not intended to limit the present disclosure. In the specification, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the presence of or the possibility of adding one or more components, steps, operations, and/or devices other than those mentioned.

Prior to the description of various embodiments of the present disclosure, some terms used herein will be clarified.

In the present specification, "aerosol-generating substrate" may refer to a material that is able to generate an aerosol. The aerosol may include a volatile compound. The aerosol-generating substrate may be a solid or liquid.

For example, solid aerosol-generating substrates may include solid materials made using tobacco raw materials such as reconstituted tobacco leaves, shredded tobacco, and reconstituted tobacco, and aerosol-generating substrates in a liquid state may include liquid compositions based on nicotine, tobacco extracts, and/or various flavoring agents. However, the scope of the present disclosure is not limited to the above-listed examples.

As a more specific example, the aerosol-generating substrates in a liquid state may include at least one of propylene glycol (PG) and glycerin (GLY) and may further include at least one of ethylene glycol, dipropylene glycol, diethylene glycol, triethylene glycol, tetraethylene glycol, and oleyl alcohol. As another example, the aerosol-generating substrate may further include at least one of nicotine, moisture, and a flavoring material. As still another example, the aerosol-generating substrate may further include various additives such as cinnamon and capsaicin. The aerosol-generating substrate may not only include a liquid material with high fluidity but also include a material in the form of gel or a solid. In this way, as the components constituting the aerosol-generating substrate, various materials may be selected according to embodiments, and composition ratios thereof may also vary according to embodiments. In the following description, "liquid" may refer to the aerosol-generating substrate in a liquid state.

In the specification, "aerosol-generating article" may refer to an article that includes an aerosol-generating substrate to generate an aerosol. A typical example of the aerosol-generating article may be a cigarette, but the scope of the present disclosure is not limited to this example.

In the specification, "aerosol generation device" may refer to a device that generates an aerosol using an aerosol-generating substrate in order to generate an aerosol that can be inhaled directly into the user's lungs through the user's mouth. Examples of the aerosol generation device may include a liquid-type aerosol generation device using a liquid cartridge and a hybrid-type aerosol generation device using a liquid cartridge and a cigarette together. However, the examples of the aerosol generation device may further include various other kinds of aerosol generation devices, and the scope of the present disclosure is not limited to the above-listed examples. Some examples of the aerosol generation device will be described below with reference to FIGS. 1, 9, and 10.

In the specification, "puff" refers to inhalation by a user, and the inhalation may refer to a situation in which a user draws in smoke into his or her oral cavity, nasal cavity, or lungs through the mouth or nose.

In the specification, "upstream" or "upstream direction" may refer to a direction moving away from an oral region of a smoker, and "downstream" or "downstream direction" may refer to a direction approaching the oral region of the smoker. The terms "upstream" and "downstream" may be used to describe relative positions of components constituting a smoking article. For example, in a smoking article 150 illustrated in FIG. 1, a filter portion 151 is disposed downstream or in a downstream direction of a medium portion 152, and the medium portion 152 is disposed upstream or in an upstream direction of the filter portion 151.

In the specification, "filter segment" may refer to one region of a filter that is logically or physically distinct. The filter segment may correspond to one portion of a single filter or one portion of multiple filters.

Hereinafter, various embodiments of the present disclosure will be described in detail with reference to the accompanying drawings.

FIG. 1 is an exemplary configuration diagram illustrating an aerosol generation system according to some embodiments of the present disclosure.

As illustrated in FIG. 1, an aerosol generation system may include an aerosol generation device 100-1 and a plurality of aerosol-generating articles 150 and 160. Although FIG. 1 illustrates an example in which the number of aerosol-generating articles is two, this is merely to provide convenience of understanding, and of course, the number of aerosol-generating articles may also be three or more. Hereinafter, each component of the aerosol generation system will be described.

The aerosol generation device 100-1 may include an accommodation space for accommodating the aerosol-generating article 150 or 160 and heat the accommodated aerosol-generating article 150 or 160 to generate an aerosol. The generated aerosol may be inhaled by a user through the oral region of the user. The aerosol generation device 100-1 may heat the aerosol-generating article 150 or 160 on the basis of a temperature profile 121 pre-installed in the aerosol generation device 100-1.

The aerosol generation device 100-1 according to an embodiment may include a heater 140, a controller 120, and a battery 130. However, only the components relating to the embodiment of the present disclosure are illustrated in FIG. 1. Therefore, those of ordinary skill in the art to which the present disclosure pertains should understand that the aerosol generation device 100-1 may further include general-purpose components other than the components illustrated in FIG. 1. Hereinafter, the components of the aerosol generation device 100-1 will be described.

The heater 140 may heat the aerosol-generating article 150 or 160 accommodated in the accommodation space to generate an aerosol. For example, as illustrated in FIG. 1, the heater 140 may heat the aerosol-generating article 150 or 160 using an external heating method. That is, the heater 140 may be disposed to surround the accommodation space to heat the aerosol-generating article 150 or 160 accommodated in the accommodation space. However, the scope of the present disclosure is not limited to this example.

The heater 140 may be implemented as an electric resistive heater, but the scope of the present disclosure is not limited thereto.

Next, the controller 120 may control the overall operation of the aerosol generation device 100-1. For example, the controller 120 may control the operation of the heater 140 and the battery 130 and also control the operation of other components included in the aerosol generation device 100-1. The controller 120 may control the power supplied by the battery 130, the heating temperature of the heater 140, and the like. As a more specific example, the controller 120 may control the heating temperature of the heater 140 on the basis of the pre-installed temperature profile 121. The temperature profile 121 may be designed in advance in such a way that maximizes a flavor of a target aerosol-generating article.

Also, the controller 120 may check a state of each of the components of the aerosol generation device 100-1 to determine whether the aerosol generation device 100-1 is in an operable state.

The controller 120 may be implemented by at least one processor. The processor may also be implemented with an array of a plurality of logic gates or implemented with a combination of a general-purpose microprocessor and a memory which stores a program that may be executed by the microprocessor. Also, those of ordinary skill in the art to which the present disclosure pertains should clearly understand that the controller 120 may also be implemented with other forms of hardware.

Next, the battery 130 may supply the power used to operate the aerosol generation device 100-1. For example, the battery 130 may supply power to allow the heater 140 to heat the aerosol-generating substrate included in the aerosol-generating article 150 or 160 and may supply power required for the controller 120 to operate.

Also, the battery 130 may supply power required to operate electrical components such as a display (not illustrated), a sensor (not illustrated), and a motor (not illustrated) which are installed in the aerosol generation device 100-1.

Next, the aerosol-generating articles 150 and 160 may generate an aerosol when heated by the heater 140. The first aerosol-generating article 150 may include the filter portion 151, the medium portion 152, and a wrapping structure that wraps around the filter portion 151 and/or the medium portion 152. The second aerosol-generating article 160 may also have a similar configuration. However, a specific structure of the aerosol-generating articles 150 and 160 may vary according to embodiments. The following description of the first aerosol-generating article 150 may also apply to the second aerosol-generating article 160.

The filter portion 151 may include a filter material that is able to filter smoke and/or an aerosol. For example, the filter material may be a cellulose acetate fiber but is not limited thereto. In some embodiments, the filter material may further include at least one filter material widely known in the art, such as a carbon-containing adsorbent or activated carbon.

The filter portion 151 may be implemented with a single filter or with a multi-filter structure such as a dual filter. Also, the filter portion 151 may include a cavity, and flavoring capsules may be added into the cavity.

Next, the medium portion 152 may include an aerosol-generating substrate and may have a downstream end portion connected to an upstream end portion of the filter portion 151. The connection between the medium portion 152 and the filter portion 151 may be performed by the wrapping structure.

Next, the wrapping structure may refer to a structure that wraps around the filter portion 151 and/or the medium portion 152. For example, the wrapping structure may include a filter wrapper that wraps around the filter portion 151, a wrapper that wraps around the medium portion 152, a tipping wrapper, and the like.

In some embodiments, the wrapping structure may further include a heat conduction member and/or a heat conduction limiting member. The heat conduction member may increase thermal energy reaching the aerosol-generating substrate, and the heat conduction limiting member may limit the thermal energy reaching the aerosol-generating substrate. That is, the wrapping structure may appropriately control the thermal energy reaching the aerosol-generating substrate through the heat conduction member and/or the heat conduction limiting member, and in this way, the flavor of the aerosol-generating article 150 may be diversified/optimized. In the present embodiment, the material, length, thickness, area, arrangement position, arrangement form, arrangement structure, and the like of the heat conduction member and/or the heat conduction limiting member may be designed and selected in various ways. Various embodiments relating to the wrapping structure will be described in detail below with reference to FIGS. 2 to 8.

In the above-described embodiment, for example, the heat conduction member may be made of a metal foil, such as an aluminum foil and a copper foil, a paper-laminated metal foil, or the like. However, the material of the heat conduction member is not limited thereto, and the heat conduction member may be made of various other materials whose thermal conductivity is higher than or equal to a reference value.

Also, the heat conduction limiting member may be made of a polymer material such as paper and a nonwoven fabric. However, the material of the heat conduction limiting member is not limited thereto, and the heat conduction limiting member may be made of various other materials whose thermal conductivity is less than or equal to a reference value.

Heat transfer control using the wrapping structure may provide the following various advantages.

For example, assume that the first aerosol-generating article 150 and the second aerosol-generating article 160 have substantially the same physical specifications, but have different wrapping structures. Also, assume that the first aerosol-generating article 150 and the second aerosol-generating article 160 are articles having different temperature profiles. For example, assume a case in which the pre-installed temperature profile 121 is a temperature profile of the second aerosol-generating article 160. In this case, since the aerosol generation device 100-1 heats the first aerosol-generating article 150 according to the temperature profile 121 of the second aerosol-generating article 160, the original taste and flavor of the first aerosol-generating article 150 may not be obtained. However, in this case, if the wrapping structure of the first aerosol-generating article 150 appropriately controls the thermal energy reaching the aerosol-generating substrate, the original flavor of the first aerosol-generating article 150 may still be provided to the user.

In other words, by appropriately controlling the heat transfer using the wrapping structure, even without changing the existing temperature profile 121 or adding a new temperature profile (that is, even when the aerosol generation device 100-1 is operated under the existing temperature profile 121), the flavor of the first aerosol-generating article 150 may be optimized. Since this makes it possible for an article manufacturer to develop aerosol-generating articles for competitors' devices in which a temperature profile cannot be installed, its market competitiveness may be improved.

As another example, assume that the first aerosol-generating article 150 and the second aerosol-generating article 160 include the same or similar aerosol-generating substrates and have different wrapping structures. In this case, since the thermal energy reaching the inside of the first aerosol-generating article 150 and the thermal energy reaching the inside of the second aerosol-generating article 160 are different, the first aerosol-generating article 150 and the second aerosol-generating article 160 may provide different flavors despite their similar aerosol-generating substrates. That is, since the two aerosol-generating articles 150 and 160 may be recognized as different products by consumers, a product diversification effect may be achieved. This may stimulate the consumer's desire to purchase, and thus the market competitiveness of the article manufacturer may be improved. For example, since various aerosol-generating articles 150 and 160 may be provided to consumers for the aerosol generation device 100-1, the consumer's willingness to purchase may be inspired.

The aerosol generation system according to some embodiments of the present disclosure has been described above with reference to FIG. 1. Hereinafter, various embodiments relating to the wrapping structure will be described in detail with reference to FIGS. 2 to 8.

FIGS. 2 and 3 schematically illustrate a wrapping structure 10-1 and an aerosol-generating article 150-1 including the same according to a first embodiment of the present disclosure.

As illustrated in FIG. 2, the aerosol-generating article 150-1 may include the filter portion 151, the medium portion 152, and the wrapping structure 10-1 that wraps around the filter portion 151 and the medium portion 152. In order to avoid repeated description, descriptions of the filter portion 151 and the medium portion 152 will be omitted.

The wrapping structure 10-1 according to the embodiment may include a wrapper 11 that wraps around the medium portion 152, a filter wrapper 12 that wraps around the filter portion 151, and a heat conduction member 13 disposed in the vicinity of a downstream end portion of the medium portion 152. Here, the heat conduction member 13 being disposed in the vicinity of the downstream end portion of the medium portion 152 may mean that the heat conduction member 13 is disposed in a wrapper that wraps around the vicinity of the downstream end portion of the medium portion 152.

More specifically, the heat conduction member 13 may be disposed at an inner side of the wrapper 11 and form an intensive heating region 153 in the vicinity of the downstream end portion of the medium portion 152. The intensive heating region 153 may refer to a region in which the thermal energy of the heater 140 is relatively concentrated. The heat conduction member 13 may be disposed to partially or entirely surround the vicinity of the downstream end portion of the medium portion 152.

In the present embodiment, as the heater 140 is operated, the heating of the intensive heating region 153 may be relatively accelerated. This may allow an aerosol to be smoothly generated upon an initial puff, and thus the overall flavor and taste of tobacco smoke of the aerosol-generating article 150-1 may be improved. In particular, an initial smoking taste of the aerosol-generating article 150-1 may be significantly improved. For example, even in a case in which the heating temperature of the heater 140 does not reach an optimum temperature of the aerosol-generating article 150-1, the original flavor of the aerosol-generating article 150-1 may be provided upon an initial puff.

Meanwhile, the type of the material constituting the heat conduction member 13 and the thickness, length, area, arrangement form, and the like of the heat conduction member 13 may be changed on the basis of various factors. For example, in order to further increase the thermal energy reaching the intensive heating region 153, a thicker heat conduction member 13 may be disposed, or the heat conduction member 13 may be made of a material having a higher thermal conductivity. As another example, in order to concentrate the thermal energy in a specific region (e.g., a region in which the density or content of aerosol-generating substrates is high) of the medium portion 152, the heat conduction member 13 may be disposed to surround only the specific region. As still another example, a plurality of heat conduction members 13 may be disposed to be spaced apart from each other in the vicinity of the downstream end portion of the medium portion 152.

In some embodiments, a flavoring agent may be added to be adjacent to the intensive heating region 153 in a downstream direction thereof. For example, as illustrated in FIG. 3, a flavoring agent 15 may be added to an upstream segment 151-2 of the filter portion 151 that is adjacent to the intensive heating region 153. Although FIG. 3 illustrates an example in which the filter portion 151 consists of a downstream segment 151-1 and the upstream segment 151-2, a specific structure of the filter portion 151 may be changed in any way. The flavoring agent 15, for example, may be added in the form of powder, granules, capsules, and the like, but the scope of the present disclosure is not limited to these examples. According to the present embodiment, since the flavoring agent 15 is added to a position close to the intensive heating region 153, thermal decomposition of the flavoring agent 15 may be accelerated. Accordingly, the flavor of the aerosol-generating article 150-1 may be further improved.

Hereinafter, a wrapping structure 10-2 according to a second embodiment of the present disclosure will be described with reference to FIG. 4. Hereinafter, for clarity of the specification, description of contents overlapping with the previous embodiments will be omitted, and differences therefrom will be mainly described.

FIG. 4 schematically illustrates the wrapping structure 10-2 and an aerosol-generating article 150-2 including the same according to the second embodiment of the present disclosure.

As illustrated in FIG. 4, the wrapping structure 10-2 may include a heat conduction member 13 disposed in the vicinity of the downstream end portion of the medium portion 152 and a heat conduction limiting member 14 disposed in a downstream direction of the heat conduction member 13. For example, the heat conduction limiting member 14 may be disposed in the vicinity of an upstream end portion of the filter portion 151 that is adjacent to the medium portion 152. Although FIG. 4 illustrates an example in which the intensive heating region 153 is formed in a partial region of the medium portion 152, the intensive heating region 153 may also be formed throughout the medium portion 152 (e.g., the heat conduction member 13 may be disposed to surround the entire medium portion 152).

In the present embodiment, the heat conduction member 13 may form the intensive heating region 153 in the vicinity of the downstream end portion of the medium portion 152, and the heat conduction limiting member 14 may form a heating-limited region 154 in a downstream direction of the intensive heating region 153. Here, the heating-limited region 154 may refer to a region in which the amount of the thermal energy transferred from the heater 140 is relatively limited.

In the present embodiment, the intensive heating region 153 may allow an aerosol to be smoothly generated, and the heating-limited region 154 may appropriately cool the generated aerosol to increase vapor production of the aerosol-generating article 150-2.

Hereinafter, a wrapping structure 10-3 according to a third embodiment of the present disclosure will be described with reference to FIG. 5.

FIG. 5 schematically illustrates the wrapping structure 10-3 and an aerosol-generating article 150-3 including the same according to the third embodiment of the present disclosure.

As illustrated in FIG. 5, the wrapping structure 10-3 may include a first heat conduction member 13-1 disposed on the downstream side of the medium portion 152 and a second heat conduction member 13-2 disposed on the upstream side thereof. The first heat conduction member 13-1 may form a first intensive heating region 153-1 in a downstream region of the medium portion 152, and the second heat conduction member 13-2 may form a second intensive heating region 153-2 in an upstream region of the medium portion 152.

Here, a thickness of the first heat conduction member 13-1 may be greater than that of the second heat conduction member 13-2. In this way, a relatively larger amount of thermal energy may be concentrated in the first intensive heating region 153-1, and since this allows an aerosol to be smoothly generated upon an initial puff, an initial taste of tobacco smoke of the aerosol-generating article 150-3 may be improved.

Also, since the intensive heating regions 153-1 and 153-2 are formed throughout the medium portion 152, the overall flavor of the aerosol-generating article 150-3 may be improved. For example, even when the heating temperature of the heater 140 does not reach an optimum temperature of the aerosol-generating article 150-3, the original flavor of the aerosol-generating article 150-3 may be obtained.

In some embodiments, the first heat conduction member 13-1 may be made of a material having a higher thermal conductivity than a material of which the second heat conduction member 13-2 is made. In this case, the thickness of the first heat conduction member 13-1 may be substantially the same as or similar to the thickness of the second heat conduction member 13-2. The above-mentioned effects may also be achieved according to the present embodiment.

Hereinafter, a wrapping structure 10-4 according to a fourth embodiment of the present disclosure will be described with reference to FIG. 6.

FIG. 6 schematically illustrates the wrapping structure 10-4 and an aerosol-generating article 150-4 including the same according to the fourth embodiment of the present disclosure.

As illustrated in FIG. 6, the wrapping structure 10-4 may include a first heat conduction member 13-1 disposed around a first region 153-1 of the medium portion 152, a second heat conduction member 13-2 disposed around a second region 153-2 of the medium portion 152, and a heat conduction limiting member 14 disposed around a third region 154 of the medium portion 152. In this case, an intensive heating region may be formed in the first region 153-1 and the second region 153-2, and a heating-limited region may be formed in the third region 154.

In the present embodiment, the thermal energy reaching each portion of the medium portion 152 may vary due to the wrapping structure 10-4. For example, even in a case in which the heater 140 consists of a single heater, a temperature to which each portion of the medium portion 152 is heated may vary due to the wrapping structure 10-4.

The present embodiment may be advantageous in a case in which the medium portion 152 consists of a plurality of segments or the heater 140 is implemented with multiple (multi-stage) heaters that are operated at different heating temperatures. For example, in a case in which the medium portion 152 consists of a plurality of segments and a temperature profile is different for each segment (e.g., the density/content of aerosol-generating substrates is different for each segment or each segment includes a different material), the heating temperature may be differently controlled for each segment by the wrapping structure 10-4, and thus the flavor of the aerosol-generating article 150-4 may be enhanced. As another example, there may be a case in which, despite the heater 140 being implemented with multiple (multi-stage) heaters that are operated at different heating temperatures, an optimum temperature of the medium portion 152 is the same for each portion. In this case, uniform thermal energy may be delivered throughout the medium portion 152 due to the wrapping structure 10-4, and thus the flavor of the aerosol-generating article 150-4 may be improved.

Meanwhile, the example of FIG. 6 is merely one embodiment of the present disclosure, and the number, arrangement position, area, and the like of the heat conduction members 13-1 and 13-2 and the heat conduction limiting member 14 may be changed in any way.

Hereinafter, a wrapping structure 10-5 according to a fifth embodiment of the present disclosure will be described with reference to FIG. 7.

FIG. 7 schematically illustrates the wrapping structure 10-5 and an aerosol-generating article 150-5 including the same according to the fifth embodiment of the present disclosure.

As illustrated in FIG. 7, the wrapping structure 10-5 may include a heat conduction member 13 disposed in the vicinity of an upstream end portion of the medium portion 152, and the heat conduction member 13 may not be disposed in the vicinity of the downstream end portion of the medium portion 152. In this case, since the thermal energy of the heater 140 is relatively concentrated in an upstream region 153 of the medium portion 152, a heating-limited region 154 may be formed in the vicinity of the downstream end portion of the medium portion 152.

In the present embodiment, the heating-limited region 154 may lower a temperature in the vicinity of the downstream end portion of the medium portion 152 to enhance a filtering effect for the generated aerosol. Here, "filtering" may not only refer to removing some components included in an aerosol, but also refer to adding other components into the aerosol. That is, "filtering" may encompass a process of changing components in the aerosol change.

Specifically, when the aerosol passes through the heating-limited region 154, some components in the aerosol may be filtered, and some components included in the heating-limited region 154 may be added into the aerosol. Therefore, components of the aerosol discharged to the outside of the aerosol-generating article 150-5 may be different from components of the initially-generated aerosol, and in this way, a different flavor may be produced as compared to when the entire medium portion 152 is heated.

Hereinafter, a wrapping structure 10-6 according to a sixth embodiment of the present disclosure will be described with reference to FIG. 8.

FIG. 8 schematically illustrates the wrapping structure 10-6 and an aerosol-generating article 150-6 including the same according to the sixth embodiment of the present disclosure.

As illustrated in FIG. 8, the wrapping structure 10-6 may include a heat conduction limiting member 14 disposed in the vicinity of the downstream end portion of the medium portion 152. The heat conduction limiting member 14 may limit the thermal energy delivered to the vicinity of the downstream end portion of the medium portion 152 to form a strengthened heating-limited region 154 in the corresponding portion. In this way, the above-mentioned aerosol filtering effect may be further enhanced, and still another flavor, which is different from the flavors according to the above-described embodiments, may be delivered to the user.

The wrapping structures 10-1 to 10-6 and the aerosol-generating articles 150-1 to 150-6 including the same according to various embodiments of the present disclosure have been described above with reference to FIGS. 2 to 8. According to the above description, the thermal energy reaching the aerosol-generating substrates may be controlled using the wrapping structures 10-1 to 10-6, and in this way, the flavors of the aerosol-generating articles 150-1 to 150-6 may be optimized/diversified.

Meanwhile, the above-described first to sixth embodiments may be combined in various forms. For example, the first heat conduction member 13-1 may be disposed on the downstream side of the medium portion 152, the second heat conduction member 13-2 may be disposed on the upstream side of the medium portion 152, and the heat conduction limiting member 14 may be disposed in a downstream direction of the first heat conduction member 13-1 (combination of the second embodiment and the third embodiment). The combination of the embodiments may be performed in consideration of various factors. Also, the material, length, thickness, arrangement position, area, and the like of the heat conduction member 13 and/or the heat conduction limiting member 14 may also be designed and selected on the basis of various factors. Examples of the various factors may include a difference between the temperature profile 121 installed in the aerosol generation device 100-1 and a temperature profile suitable for an aerosol-generating article (e.g., the aerosol-generating article 150), the heating structure and performance of the heater 140, physical specifications (e.g., a size limit) for an aerosol-generating article (e.g., the aerosol-generating article 150), and the like.

Hereinafter, aerosol generation devices 100-2 and 100-3 to which the aerosol-generating article 150 according to some embodiments of the present disclosure may be applied will be described with reference to FIGS. 9 and 10.

FIGS. 9 and 10 are exemplary block diagrams illustrating the aerosol generation devices 100-2 and 100-3. Specifically, FIG. 9 illustrates the aerosol generation device 100-2 in which a vaporizer 1 and the aerosol-generating article 150 are disposed in parallel, and FIG. 10 illustrates the aerosol generation device 100-3 in which the vaporizer 1 and the aerosol-generating article 150 are disposed in series.

As illustrated in FIG. 9 or 10, the aerosol generation device 100-2 or 100-3 may include the vaporizer 1, the heater 140, the battery 130, and the controller 120. However, this is merely a preferred embodiment for achieving the objectives of the present disclosure, and of course, some components may be added or omitted as necessary. Also, the components of each of the aerosol generation device 100-2 illustrated in FIG. 9 and the aerosol generation device 100-3 illustrated in FIG. 10 represent functional components that are functionally distinct, and the plurality of components may be implemented to be integrated with each other in an actual physical environment, or a single component may be implemented to be divided into a plurality of specific functional components.

The vaporizer 1 may include a liquid reservoir configured to store an aerosol-generating substrate in a liquid state, a wick configured to absorb the aerosol-generating substrate, and a heating element configured to heat the absorbed aerosol-generating substrate to generate an aerosol. The aerosol generated in the vaporizer 1 may pass through the aerosol-generating article 150 to be inhaled by a user through the oral region of the user. The heating element of the vaporizer 1 may also be controlled by the controller 120.

Refer to the above description relating to FIG. 1 for descriptions of the controller 120, the battery 130, and the heater 140.

The aerosol generation devices 100-2 and 100-3 according to some embodiments of the present disclosure have been described above with reference to FIGS. 9 and 10.

All the components constituting the embodiments of the present disclosure have been described above as being combined into one body or being operated in combination, but the technical idea of the present disclosure is not necessarily limited to the embodiments. That is, any one or more of the components may be selectively operated in combination within the intended scope of the present disclosure.

The embodiments of the present disclosure have been described above with reference to the accompanying drawings, but those of ordinary skill in the art to which the present disclosure pertains should understand that the present disclosure may be embodied in other specific forms without changing the technical idea or essential features thereof. Therefore, the embodiments described above should be understood as being illustrative, instead of limiting, in all aspects. The scope of the present disclosure should be interpreted by the claims below, and any technical idea within the scope equivalent to the claims should be interpreted as falling within the scope of the technical idea defined by the present disclosure.

What is claimed is:

1. An aerosol-generating article comprising:

a filter portion;

a medium portion which includes an aerosol-generating substrate, wherein a downstream end portion of the medium portion is connected to an upstream end portion of the filter portion; and a wrapping structure which wraps around at least one of the filter portion or the medium portion, wherein the wrapping structure includes a heat conduction member disposed in a first position, which is a vicinity of the downstream end portion of the medium portion.

2. The aerosol-generating article of claim 1, wherein the heat conduction member includes a metal foil or a paper-laminated metal foil.

3. The aerosol-generating article of claim 1, wherein the wrapping structure further includes a heat conduction limiting member disposed in a downstream direction of the heat conduction member.

4. The aerosol-generating article of claim 3, wherein the heat conduction limiting member includes paper or a non-woven fabric.

5. The aerosol-generating article of claim 1, wherein the filter portion includes an upstream filter segment and a downstream filter segment, and a flavoring agent is added to the upstream filter segment.

6. The aerosol-generating article of claim 1, wherein the heat conduction member is a first heat conduction member, the wrapping structure further includes a second heat conduction member disposed in a second position which is different from the first position, and the first heat conduction member is thicker than the second heat conduction member.

7. The aerosol-generating article of claim 1, wherein the heat conduction member is a first heat conduction member, the wrapping structure further includes a second heat conduction member disposed at a different position from the first heat conduction member, and the first heat conduction member includes a material having a higher thermal conductivity than the second heat conduction member.

8. The aerosol-generating article of claim 1, wherein the heat conduction member is a first heat conduction member, and the wrapping structure further includes a second heat conduction member disposed around a first region of the medium portion and a heat conduction limiting member disposed around a second region of the medium portion.

9. An aerosol-generating article comprising:

a filter portion;

a medium portion which includes an aerosol-generating substrate, wherein a downstream end portion of the medium portion is connected to an upstream end portion of the filter portion; and a wrapping structure which wraps around at least one of the filter portion or the medium portion, wherein the wrapping structure includes a heat conduction member disposed at a first position that is different from a second position that is a vicinity of the downstream end portion of the medium portion.

10. The aerosol-generating article of claim 9, wherein the wrapping structure further includes a heat conduction limiting member disposed in the second position that is the vicinity of the downstream end portion of the medium portion.

11. An aerosol generation system comprising:

a first aerosol-generating article having a first wrapping structure;

a second aerosol-generating article having a second wrapping structure that is different from the first wrapping structure of the first aerosol-generating article; and an aerosol generation device comprising an accommodation space for accommodating the first aerosol-generating article or the second aerosol-generating article, and configured to heat the second aerosol-generating article accommodated in the accommodation space according to a temperature profile of the first aerosol-generating article to generate an aerosol, wherein the aerosol generation device further comprises a filter portion and a medium portion which includes an aerosol-generating substrate, and wherein a downstream end portion of the medium portion is connected to an upstream end portion of the filter portion.

* * * * *